US008115786B2

(12) United States Patent
Chang

(10) Patent No.: US 8,115,786 B2
(45) Date of Patent: Feb. 14, 2012

(54) LIQUID CRYSTAL DRIVING CIRCUIT

(75) Inventor: Yu-Chao Chang, Sinshih Township, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 893 days.

(21) Appl. No.: 12/078,605

(22) Filed: Apr. 2, 2008

(65) Prior Publication Data

US 2009/0251495 A1 Oct. 8, 2009

(51) Int. Cl.
*G09G 5/10* (2006.01)

(52) U.S. Cl. ..... 345/690

(58) Field of Classification Search ..... 345/690, 345/55, 100

See application file for complete search history.

(56) References Cited

U.S. PATENT DOCUMENTS 5,317,203 A * 5/1994 Tanaka et al. ..... 327/94
6,529,180 B1 * 3/2003 Ito et al. ..... 345/89
6,876,254 B2 * 4/2005 Shirasaki ..... 330/51
7,116,171 B2 * 10/2006 Maekawa et al. ..... 330/253

FOREIGN PATENT DOCUMENTS

WO WO 2006/123551 * 5/2006

* cited by examiner

*Primary Examiner* — Quan-Zhen Wang
*Assistant Examiner* — David Lee
(74) *Attorney, Agent, or Firm* — Rabin & Berdo, P.C.

(57) ABSTRACT

The liquid crystal driving circuit for converting pixel values into driving voltages on a plurality of channels includes a reference voltage generating circuit, a plurality of buffer amplifiers, an output selection circuit coupling, and a plurality of switch circuits. The reference voltage generating circuit generates a plurality of grayscale reference voltages. Each buffer amplifier corresponds to one of the grayscale voltages and is powered by a supply voltage. The output selection circuit couples to the channels to outputs of the buffer amplifiers selected according to the pixel values. The switch circuits couples inputs of the selected buffer amplifiers to receive the corresponding grayscale reference voltages, and couples inputs of the unselected buffer amplifiers to receive the supply voltage.

8 Claims, 6 Drawing Sheets

LIQUID CRYSTAL DRIVING CIRCUIT

BACKGROUND

1. Field of Invention

The present invention relates to a liquid crystal driving circuit. More particularly, the present invention relates to low power consumption LCD driving circuit.

2. Description of Related Art

How to reduce the power consumption of the electronic device is an important object in the past few years. Such as the cellular phone, there is only a limited space in a cellular phone, a large capacitance battery cannot be mounted, and power consumption of a circuit in the phone needs to be reduced as much as possible to extend the usage time.

FIG. 1 depicts a block diagram showing a conventional signal line driving circuit. The driving circuit includes a shift register 110, a plurality of data latch circuits 120, a load latch circuit 130, a level shifter 140, a D/A converter 150, a plurality of buffer amplifiers 160, and a reference voltage generating circuit 180. The shift register 110 is arranged for successively shifting a shift pulse supplied from the outside in synchronization with a transfer clock. The data latch circuits 120 are arranged for latching digital grayscale data in synchronization with the shift pulse outputted from each output terminal of the shift register 110. The load latch circuit 130 is arranged for latching outputs of the data latch circuits 120 at the same time. The level shifter 140 is used for converting a level of an output of the load latch circuit 130. The D/A converter 150 is used for outputting an analog voltage in accordance with an output of the level shifter 140. The buffer amplifiers 160 are arranged for buffering an output of the D/A converter 150. The reference voltage generating circuit 180 is used for generating an analog reference voltage corresponding to the digital grayscale data. Each output of the buffer amplifiers 160 is supplied to each signal line 170.

Hence, the large number of buffer amplifiers 160 consumes the power of electronic devices, and increases the chip size of the driving circuit. Therefore, it is desirable to improve the design of the liquid crystal driving circuit to reduce the number of buffer amplifiers and the power consumption.

SUMMARY

Accordingly, one embodiment of the present invention provides a liquid crystal driving circuit for converting pixel values into driving voltages on a plurality of channels. The liquid crystal driving circuit includes a reference voltage, a plurality of buffer amplifiers, an output selection circuit, and a plurality of switch circuits.

The reference voltage generating circuit generates a plurality of grayscale reference voltages. Each of buffer amplifiers is powered by a supply voltage and corresponds to one of the grayscale voltages. The output selection circuit couples to the channels to the outputs of the buffer amplifiers selected according to the pixel values. The switch circuits couple the inputs of the selected buffer amplifiers to receive the corresponding grayscale reference voltages, and couple the inputs of the unselected buffer amplifiers to receive the supply voltage.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
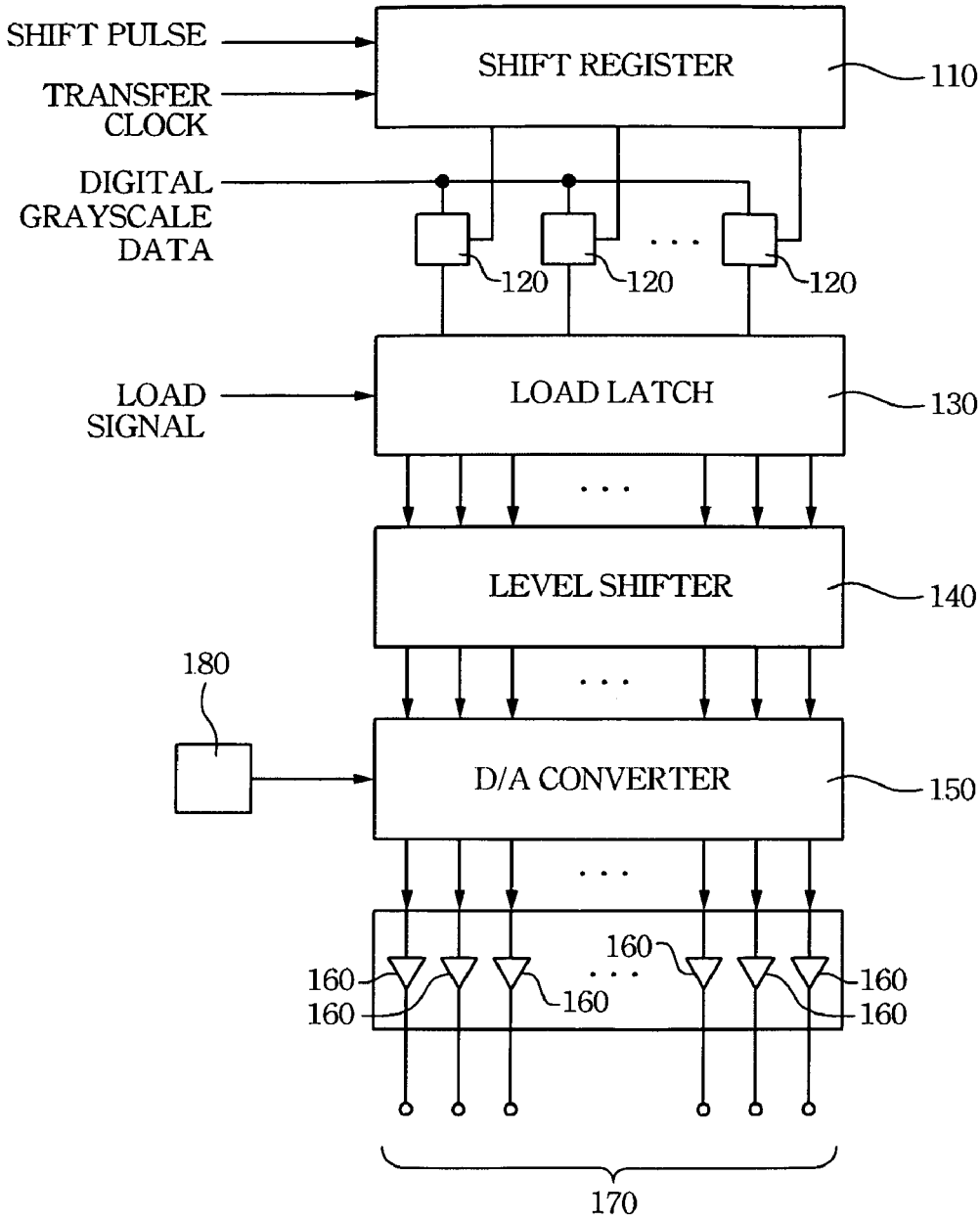
Fig. 1 (PRIOR ART)
FIG. 1 depicts a block diagram showing a conventional signal line driving circuit.

Reference will now be made in detail to the present embodiments of the invention, examples of which are illustrated in the accompanying drawings. Wherever possible, the same reference numbers are used in the drawings and the description to refer to the same or like parts.

Figure 2:
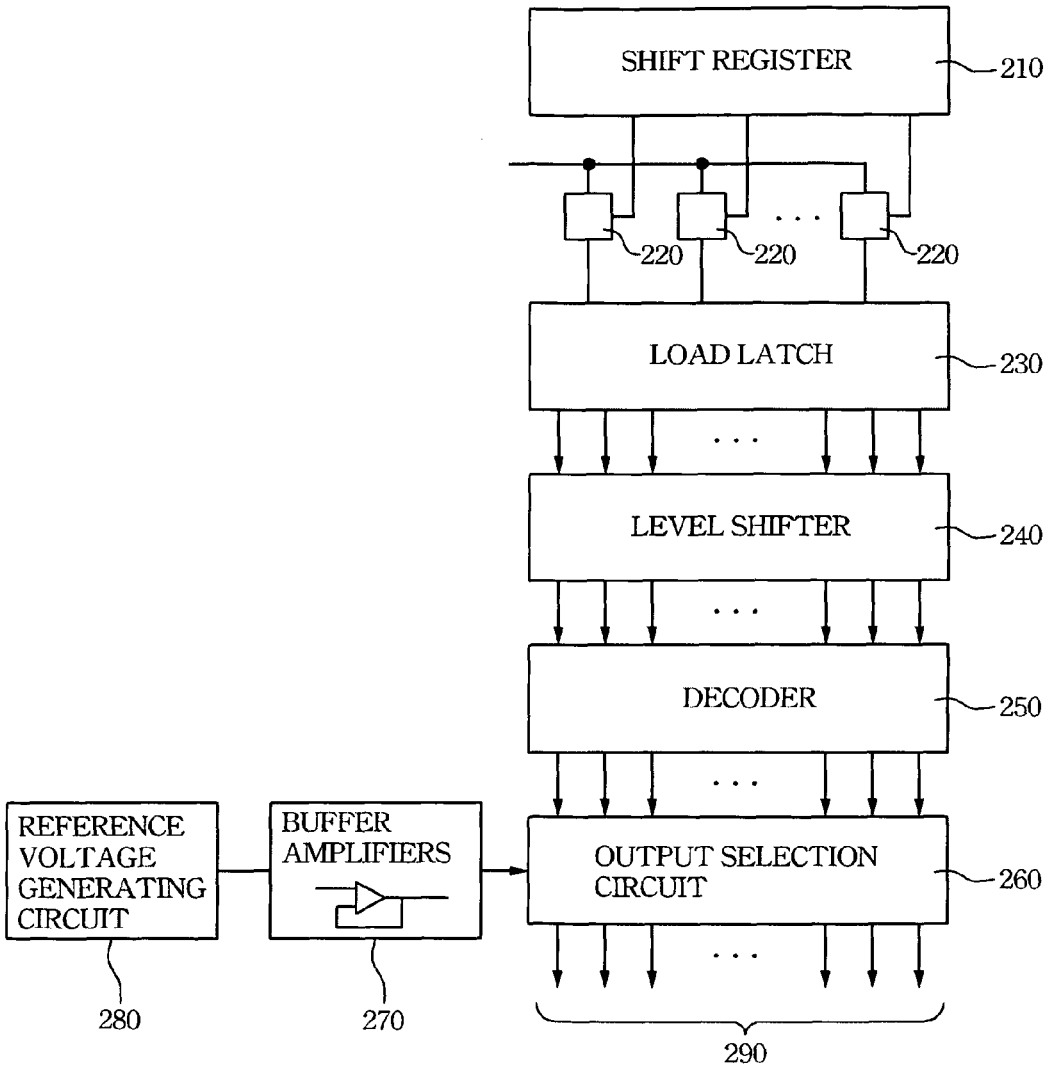
FIG. 2 depicts a block diagram showing a liquid crystal driving circuit according to the embodiment of the present invention.
Figure 3:
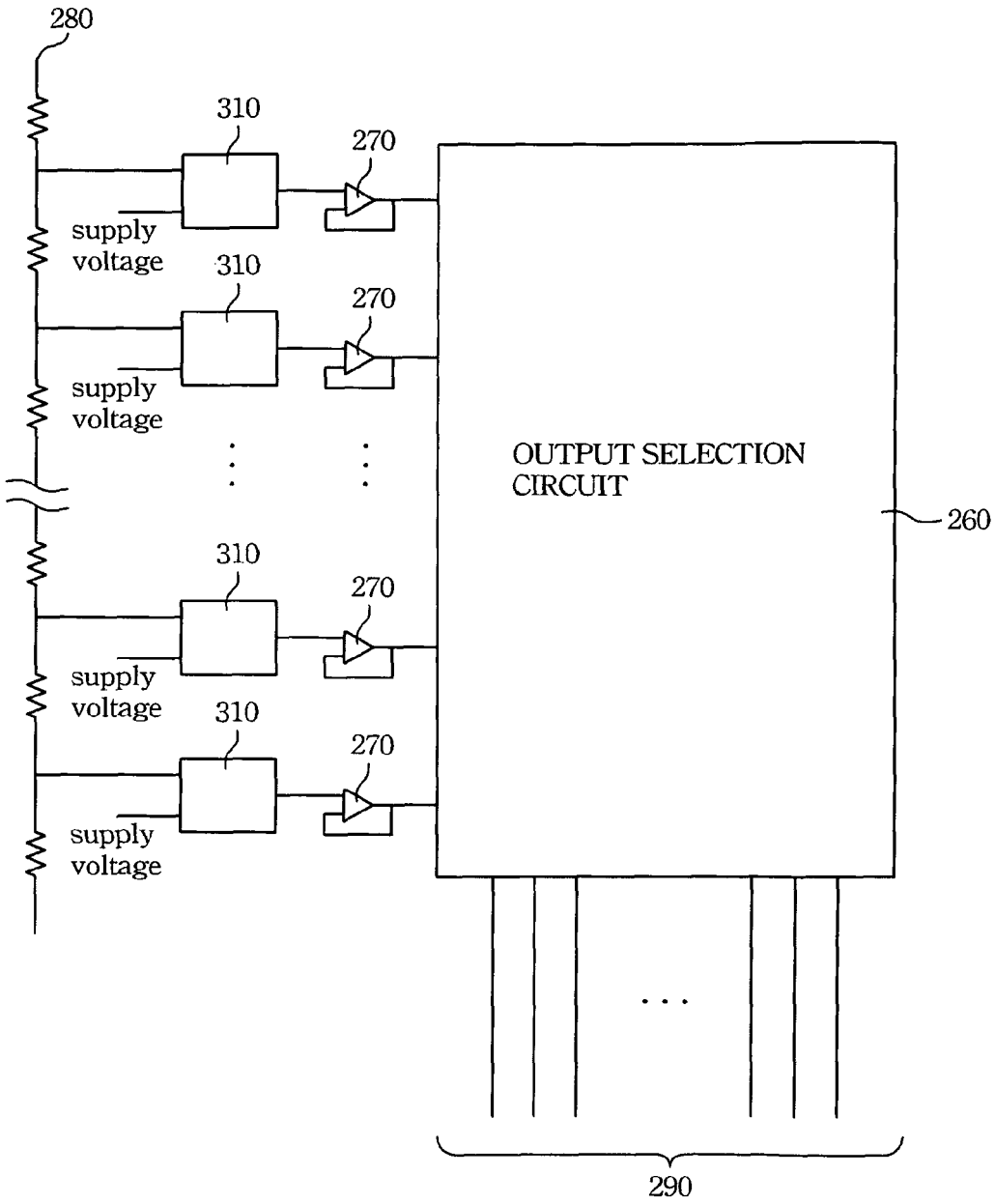
FIG. 3 depicts a circuit diagram showing a configuration of the buffer amplifiers and the reference voltage generating circuit according to the embodiment of the present invention.

The present invention of the embodiments discloses a liquid crystal driving circuit for converting pixel values into driving voltages on a plurality of channels. Please refer to FIG. 2 and FIG. 3. FIG. 2 depicts a block diagram showing a liquid crystal driving circuit. FIG. 3 depicts a circuit diagram showing a configuration of the buffer amplifiers 270 and the reference voltage generating circuit 280. The liquid crystal driving circuit includes a shift register 210, a plurality of data latch circuits 220, a load latch 230, a level shifter 240, a decoder 250, a output selection circuit 260, a plurality of amplifiers 270, and a reference voltage generating circuit 280. However, the functions of most of the elements for driving data lines 290 are known in the art, therefore, the detail functions of the shift register 210, the plurality of data latch circuits 220, the load latch 230, the level shifter 240, and the decoder 250 are not described herein.

In this embodiment, the reference voltage generating circuit 280 generates a plurality of grayscale reference voltages. Each buffer amplifier 270 is corresponded to one of the grayscale voltages and powered by a supply voltage. The output selection circuit 260 couples the channels 290 to the outputs of the buffer amplifiers 270 according to the pixel values. In addition, a plurality of switch circuits 310 are arranged between the buffer amplifiers 270 and the reference voltage generating circuit 280. The switch circuits 310 couple the inputs of the selected buffer amplifiers 270 to receive the corresponding grayscale reference voltages, and couple inputs of the unselected buffer amplifiers to receive the supply voltage.

In this embodiment, the buffer amplifier 270 can be a NMOS differential input pair buffer amplifier or a PMOS differential input pair buffer amplifier. When the input of the unselected buffer amplifier receives the supply voltage, the unselected buffer amplifier changes to the input swap mode. In the input swap mode, the output of the buffer amplifier follows the input of the buffer amplifier and does not vibrate. Moreover, the buffer amplifier does not consume power in the input swap mode. For example, the output voltage is equally to the input voltage which is the ground voltage in the unselected NMOS buffer amplifier. Therefore, the number of the operating buffer amplifier is reduced, and the output of the unselected buffer amplifier is stable. Hence, the power consumption and the chip size can be reduced.

Figure 4:
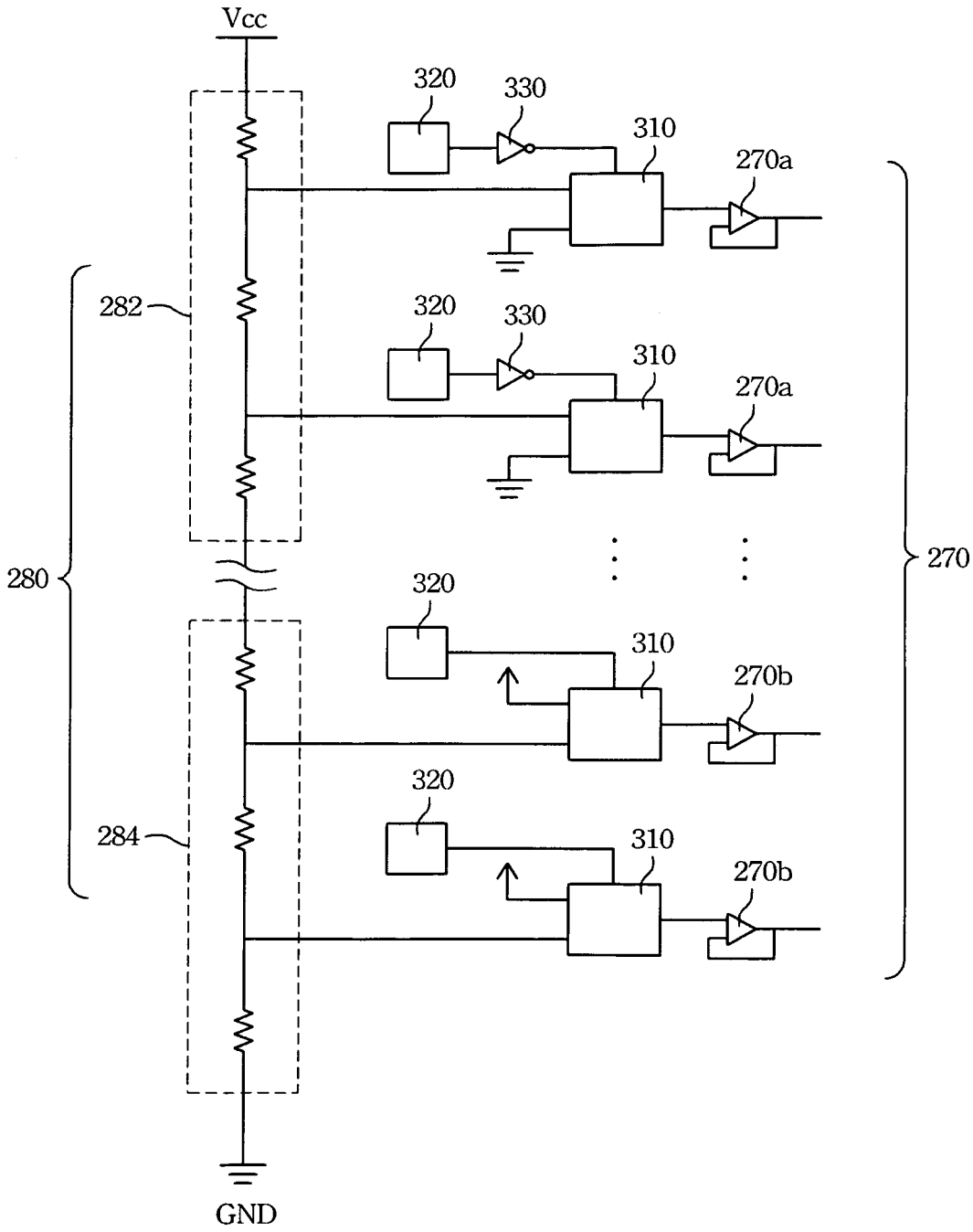
FIG. 4 depicts a circuit diagram showing a configuration of the buffer amplifiers and the reference voltage generating circuit of one embodiment.

Please refer to FIG. 4. FIG. 4 depicts a circuit diagram showing a configuration of the buffer amplifiers 270 and the reference voltage generating circuit 280 of another embodiment. The reference voltage generating circuit 280 divides an external voltage between two power supply voltages (Vcc and GND) by using a plurality of resistors connected in series and generates the analog reference voltage. Unfortunately, the input range of the NMOS differential input pair buffer amplifier or the PMOS differential input pair buffer amplifier is limited. For example, when the input voltage is lower than a threshold, the output of the NMOS differential input pair buffer amplifier cannot follow the input voltage.

In order to solve the problem described above, the reference voltage generating circuit 280 is divided into a high voltage generating part 282 and a low voltage generating part 284 according to the medium value of the rail voltage difference (the difference between Vcc and GND) of the reference voltage generating circuit 280 in another embodiment. Moreover, the plurality of buffer amplifiers is composed of NMOS differential input pair buffer amplifiers and PMOS differential input pair buffer amplifiers. Each NMOS differential input pair buffer amplifier is individually configured corresponding to one of the grayscale voltages from the high voltage generating part 282. Each PMOS differential input pair buffer amplifier is individually configured corresponding to one of the grayscale voltages from the low voltage generating part 284.

Figure 5:
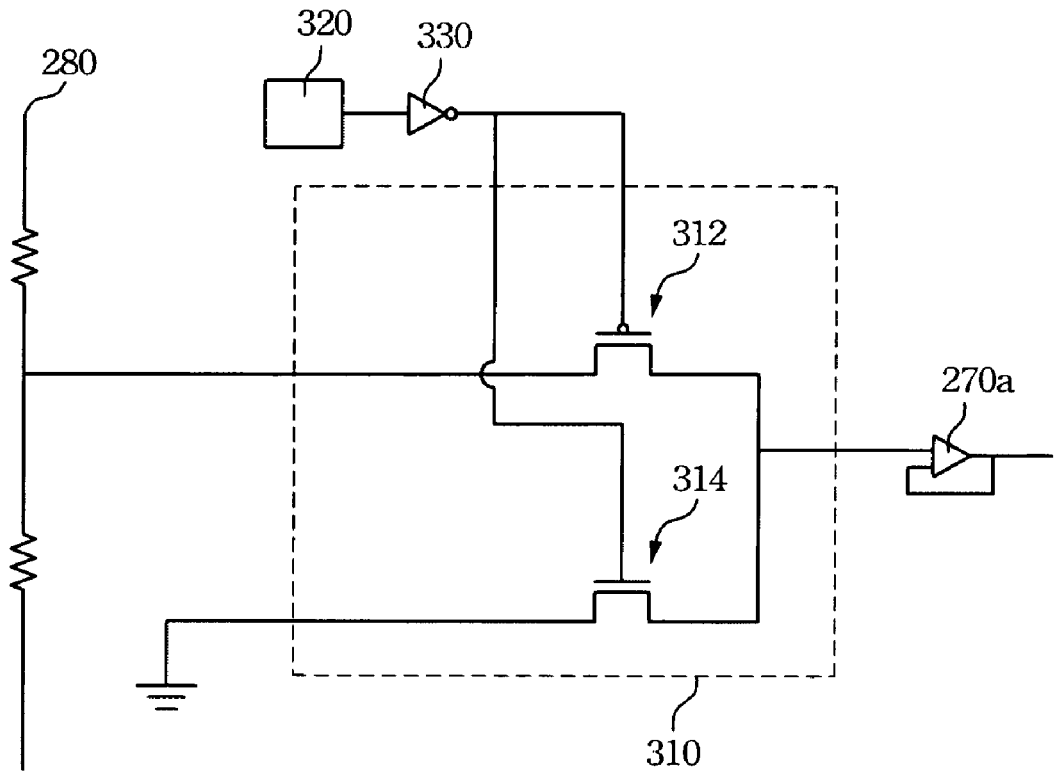
FIG. 5 depicts the switch circuit according to the embodiment of the present invention.

FIG. 5. depicts the switch circuit of the embodiments. Each switch circuit is composed of a PMOS 312 and a NMOS 314. In FIG. 5, the buffer amplifier is NMOS differential input pair buffer amplifier 270*a*. Drains of the PMOS 312 and NMOS 314 are coupled to the input of the NMOS differential input pair buffer amplifier. The source of the PMOS 312 is coupled the corresponding reference voltage and the source of NMOS 314 is coupled the supply voltage which is ground voltage here.

The embodiments of the liquid crystal driving circuit further include a plurality of switch signal generating circuits 320 generating a control signal to the switch circuits 310 based on the pixel values. Moreover, the liquid crystal driving circuit includes inverters 330. Each inverter 330 is configured between the switch circuits 310 and the switch signal generating circuit 320 when the buffer amplifiers are NMOS differential input pair buffer amplifiers 270*a*. Hence, the switch circuits 310 can couple the inputs of the selected buffer amplifiers 270*a* to receive the corresponding grayscale reference voltages, and couple the inputs of the unselected buffer amplifiers 270*a* to receive the supply voltage which is ground voltage here. Therefore, the output follows the input of the NMOS buffer amplifier 270*a* and does not vibrate. Moreover, the unselected NMOS buffer amplifier 270*a* does not consume power.

Figure 6:
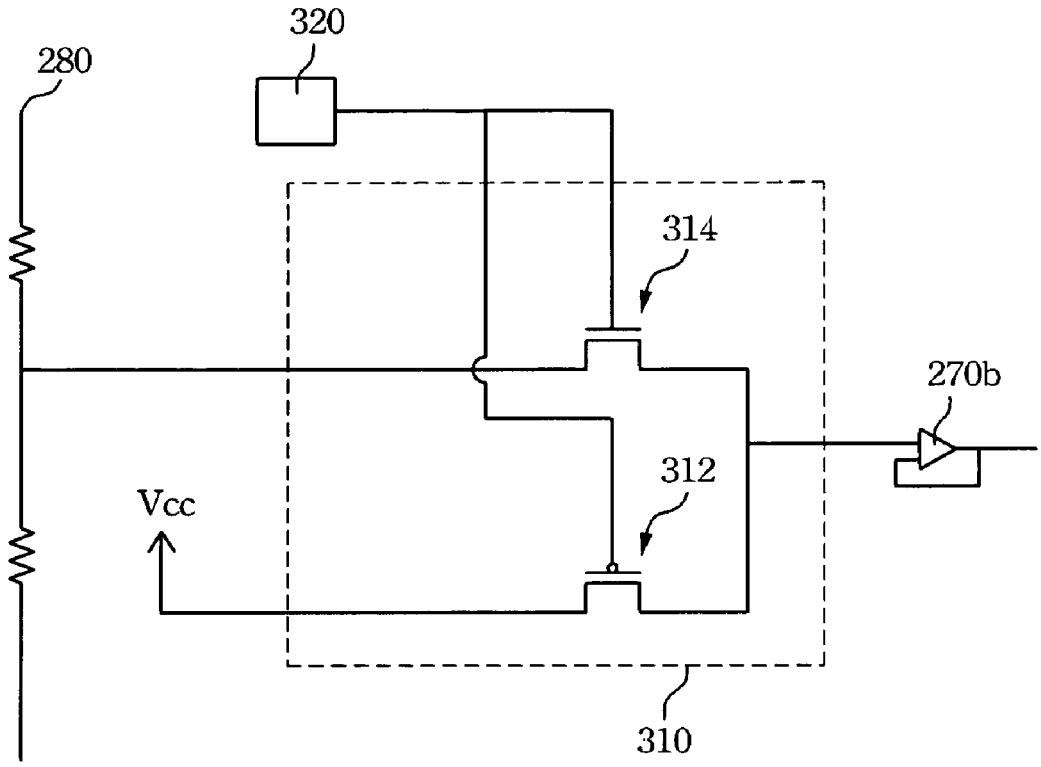
FIG. 6 depicts the switch circuit of according to another embodiment of the present invention.

FIG. 6 depicts the switch circuit according to another embodiment of the present invention. The switch circuit in this embodiment is similar to the switch circuit shown in FIG. 5, except that the buffer amplifiers 270 is the PMOS differential input pair buffer amplifier 270*b*. Also, the switch signal generating circuits 320 is electrically connected to the PMOS 312 and the NMOS 314 without the inverter 330. In addition, the source of the PMOS 312 is electrically connected to the VCC for passing a lossless VCC, while the drain of the NMOS 314 is electrically connected to the reference voltage generating circuit 280.

Drains of the PMOS 312 and the NMOS 314 are coupled to the input of one PMOS differential input pair buffer amplifier 270*b*. The drain of the NMOS 314 is coupled the corresponding reference voltage, and the source of the PMOS 312 is coupled to supply voltage which is VCC here.

The embodiments of the present invention reduce the number of the buffer amplifiers, and couple the supply voltage to the input of the unselected buffer amplifiers so that the unselected buffer amplifiers change to the input swap mode. Hence, the embodiments of the invention can reduce the power consumption and the chip size of the liquid crystal driving circuit.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A liquid crystal driving circuit for converting pixel values into driving voltages on a plurality of channels, comprising:

a reference voltage generating circuit generating a plurality of grayscale reference voltages, wherein the reference voltage generating circuit is divided into a high voltage generating part and a low voltage generating part according to the medium value of the rail voltage difference that is the difference between a Vcc and a ground voltage;

a plurality of buffer amplifiers each corresponding to one of the grayscale voltages, wherein the buffer amplifiers are composed of a plurality of NMOS differential input pair buffer amplifiers each individually corresponding to one of the grayscale voltages from the high voltage generating part and a plurality of PMOS differential input pair buffer amplifiers each individually corresponding to one of the grayscale voltages from the low voltage generating part;

an output selection circuit coupling the channels to outputs of the selected buffer amplifiers according to the pixel values; and a plurality of switch circuits coupling inputs of the selected buffer amplifiers to receive the corresponding grayscale reference voltages, and coupling inputs of the unselected buffer amplifiers to receive a supply voltage that is the ground voltage or the Vcc.

2. The liquid crystal driving circuit as claimed in claim 1, wherein the buffer amplifiers are PMOS differential input pair buffer amplifiers and the supply voltage is VCC.

3. The liquid crystal driving circuit as claimed in claim 1, wherein each switch circuit is composed of a PMOS and an NMOS, drains of the PMOS and the NMOS of each switch circuit are coupled to the input of one NMOS differential input pair buffer amplifier, the source of the PMOS in each switch circuit is coupled to the corresponding reference voltage, and the source of the NMOS is coupled to the supply voltage of the NMOS differential input pair buffer amplifier.

4. The liquid crystal driving circuit as claimed in claim 1, further comprising a plurality of switch signal generating circuits generating a control signal to the switch circuits based on the pixel values.

5. The liquid crystal driving circuit as claimed in claim 4, further comprising inverters, each inverter configured between the plurality of switch circuits and the switch signal generating circuit for the buffer amplifiers that are NMOS differential input pair buffer amplifiers.

6. The liquid crystal driving circuit as claimed in claim 1, wherein each switch circuit is composed of a PMOS and an NMOS, drains of the PMOS and the NMOS in each switch circuit are coupled to the input of one PMOS differential input pair buffer amplifier, the source of the NMOS is coupled to the corresponding reference voltage, and the source of the PMOS is coupled to the supply voltage of the PMOS differential input pair buffer amplifier.

7. The liquid crystal driving circuit as claimed in claim 1, wherein the buffer amplifiers are NMOS differential input pair buffer amplifiers and the supply voltage is the ground voltage.

8. The liquid crystal driving circuit as claimed in 7, wherein each switch circuit is composed of a PMOS and an NMOS, drains of the PMOS and the NMOS of each switch circuit are coupled to the input of one NMOS differential input pair buffer amplifier, the source of the PMOS in each switch circuit is coupled to the corresponding reference voltage, and the source of the NMOS is coupled to the supply voltage of the NMOS differential input pair buffer amplifier.

* * * * *